US008721376B1

(12) United States Patent
Bishop

(10) Patent No.: US 8,721,376 B1
(45) Date of Patent: May 13, 2014

(54) SINGLE ELEMENT WIRE TO BOARD CONNECTOR

(71) Applicant: AVX Corporation, Fountain Inn, SC (US)

(72) Inventor: Peter Bishop, Cambs (GB)

(73) Assignee: AVX Corporation, Fountain Inn, SC (US)

( * ) Notice: Subject to any disclaimer, the term of this patent is extended or adjusted under 35 U.S.C. 154(b) by 0 days.

(21) Appl. No.: 13/666,427

(22) Filed: Nov. 1, 2012

(51) Int. Cl.
*H01R 11/22* (2006.01)

(52) U.S. Cl.
USPC ..... 439/853; 439/856; 439/441

(58) Field of Classification Search
USPC ..... 439/436–441, 850–858, 860, 842, 249, 439/250, 830, 834, 252, 78–84, 861, 862
See application file for complete search history.

(56) References Cited

U.S. PATENT DOCUMENTS

| | | | | | |
|---|---|---|---|---|---|
| 1,622,631 | A | * | 3/1927 | Fahnestock | 439/857 |
| 2,122,252 | A | * | 6/1938 | Hayes | 174/87 |
| 2,603,681 | A | * | 7/1952 | Salisbury | 439/58 |
| 2,689,337 | A | * | 9/1954 | Burtt et al. | 439/851 |
| 3,076,953 | A | * | 2/1963 | Sloop | 439/857 |
| 3,162,501 | A | * | 12/1964 | Wahl | 439/399 |
| 3,221,293 | A | * | 11/1965 | Regan | 439/830 |
| 3,363,224 | A | * | 1/1968 | Gluntz et al. | 439/852 |
| 3,437,983 | A | * | 4/1969 | Gilissen | 439/716 |
| 3,479,634 | A | * | 11/1969 | Pritulsky | 439/560 |
| 3,510,831 | A | * | 5/1970 | De Vito | 439/853 |
| 3,555,497 | A | * | 1/1971 | Watanabe | 439/857 |
| 3,566,342 | A | * | 2/1971 | Schmitt et al. | 439/747 |
| 3,601,775 | A | * | 8/1971 | Longenecker et al. | 439/636 |
| 3,609,640 | A | * | 9/1971 | Longenecker et al. | 439/345 |
| 3,621,444 | A | * | 11/1971 | Stein | 439/109 |
| 3,654,583 | A | * | 4/1972 | Mancini | 439/82 |
| 3,663,931 | A | * | 5/1972 | Brown | 439/75 |
| 3,673,551 | A | * | 6/1972 | McDonough | 439/853 |
| 3,678,261 | A | * | 7/1972 | McNeil | 362/307 |
| 3,711,819 | A | * | 1/1973 | Matthews | 439/682 |
| 3,718,895 | A | * | 2/1973 | Reynolds et al. | 439/853 |
| 3,720,907 | A | * | 3/1973 | Asick | 439/636 |
| 3,778,755 | A | * | 12/1973 | Marks | 439/853 |
| 3,796,988 | A | * | 3/1974 | Palombella | 439/853 |
| 3,805,116 | A | * | 4/1974 | Nehmann | 361/809 |
| 3,818,423 | A | * | 6/1974 | McDonough | 439/857 |
| 3,824,557 | A | * | 7/1974 | Mallon | 439/857 |

(Continued)

OTHER PUBLICATIONS

Final Office Action received in U.S. Appl. No. 13/927,231 mailed Dec. 6, 2013 (5 pages).

(Continued)

*Primary Examiner* — Ross Gushi
(74) *Attorney, Agent, or Firm* — Foley & Lardner, LLP

(57) ABSTRACT

A single element electrical connector includes a single conductive contact element formed into a cage structure having a wire insert end and a wire contact end along a longitudinal centerline axis of the connector. The cage structure defines an upper pick-up surface having a surface area suitable for placement of a suction nozzle of a vacuum transfer device, as well as a pair of contact tines biased towards the centerline axis to define a contact pinch point for an exposed core of a wire inserted into the connector. A contact surface is defined by a member of the cage structure for electrical mating contact with a respective contact element on a component on which the connector is mounted.

16 Claims, 4 Drawing Sheets

(56) References Cited

U.S. PATENT DOCUMENTS 3,846,735 A * 11/1974 Carter et al. 439/284
3,850,500 A * 11/1974 Cobaugh et al. 439/858
3,853,389 A * 12/1974 Occhipinti 439/747
3,867,008 A * 2/1975 Gartland, Jr. 439/857
3,907,392 A * 9/1975 Haag et al. 439/218
3,915,537 A * 10/1975 Harris et al. 439/249
3,915,544 A * 10/1975 Yurtin 439/786
3,937,553 A * 2/1976 Maximoff et al. 439/853
3,945,710 A * 3/1976 Gartland, Jr. 439/857
3,950,065 A * 4/1976 Renn 439/398
3,955,869 A * 5/1976 Licht 439/218
3,963,302 A * 6/1976 Gourley 439/867
3,963,316 A 6/1976 Williams
3,989,331 A * 11/1976 Hanlon 439/70
3,992,076 A * 11/1976 Gluntz 439/853
4,012,107 A * 3/1977 Cobaugh et al. 439/82
4,076,369 A * 2/1978 Ostapovitch 439/852
4,083,623 A * 4/1978 Lynch 439/741
4,152,042 A * 5/1979 Ostapovitch 439/852
4,193,660 A * 3/1980 Jaconette 439/752
4,214,801 A * 7/1980 Cairns et al. 439/374
4,232,931 A * 11/1980 Takeuchi et al. 439/857
4,262,983 A 4/1981 Bogese, II
4,299,436 A * 11/1981 Ackerman 439/853
4,317,609 A * 3/1982 Lapraik 439/733.1
4,331,376 A * 5/1982 Leather 439/689
4,359,258 A * 11/1982 Palecek et al. 439/741
4,379,611 A * 4/1983 Foege et al. 439/747
4,472,017 A * 9/1984 Sian 439/872
4,527,857 A * 7/1985 Hughes et al. 439/849
4,556,274 A * 12/1985 Olivera 439/620.34
4,585,295 A * 4/1986 Ackerman 439/857
4,605,277 A * 8/1986 DeFilippis et al. 439/682
4,618,205 A * 10/1986 Freeman 439/573
4,640,561 A * 2/1987 George 439/77
4,643,510 A * 2/1987 Urani 439/830
4,657,336 A * 4/1987 Johnson et al. 439/852
4,708,416 A * 11/1987 Awano 439/851
4,728,304 A * 3/1988 Fischer 439/842
4,740,180 A * 4/1988 Harwath et al. 439/856
4,767,342 A * 8/1988 Sato 439/78
4,772,234 A * 9/1988 Cooper 439/851
4,781,602 A * 11/1988 Cobaugh 439/82
4,784,622 A * 11/1988 Senor 439/853
4,813,881 A * 3/1989 Kirby 439/74
4,822,288 A * 4/1989 Conley 439/84
4,907,990 A * 3/1990 Bertho et al. 439/851
4,932,891 A * 6/1990 Spanke et al. 439/395
4,932,906 A * 6/1990 Kaley et al. 439/857
4,934,967 A * 6/1990 Marks et al. 439/856
4,952,178 A * 8/1990 Beer 439/856
4,968,271 A * 11/1990 Buscella 439/860
5,024,627 A * 6/1991 Bennett et al. 439/631
5,035,658 A * 7/1991 Berg 439/748
5,038,467 A * 8/1991 Murphy 29/845
5,046,972 A * 9/1991 Pass 439/751
5,049,095 A * 9/1991 Gugelmeyer 439/856
5,064,379 A * 11/1991 Ryll et al. 439/81
5,116,238 A * 5/1992 Holloman 439/441
5,131,853 A * 7/1992 Meyer 439/82
5,152,702 A * 10/1992 Pilny 439/876
5,167,544 A * 12/1992 Brinkman et al. 439/856
5,169,322 A * 12/1992 Frantz et al. 439/82
5,213,530 A * 5/1993 Uratsuji 439/268
5,263,883 A * 11/1993 Kirayoglu 439/856
5,269,712 A * 12/1993 Denlinger et al. 439/845
5,352,125 A * 10/1994 Banakis et al. 439/83
5,362,244 A * 11/1994 Hanson et al. 439/82
5,383,800 A * 1/1995 Saka et al. 439/787
5,397,254 A * 3/1995 Powell 439/885
5,399,108 A * 3/1995 Lu et al. 439/682
5,415,571 A * 5/1995 Lutsch 439/843
5,458,513 A * 10/1995 Matsuoka 439/857
5,529,517 A * 6/1996 Hopf et al. 439/843
5,551,897 A * 9/1996 Alwine 439/850
5,611,717 A * 3/1997 Joly 439/857
5,615,944 A * 4/1997 Siegfried et al. 362/548
5,618,187 A * 4/1997 Goto 439/79
5,645,458 A * 7/1997 Hotea 439/852
5,664,972 A * 9/1997 Zinn et al. 439/839
5,676,570 A * 10/1997 Scherer 439/787
5,713,767 A * 2/1998 Hanson et al. 439/853
5,769,672 A * 6/1998 Flieger 439/850
5,788,539 A * 8/1998 Fedder 439/682
5,888,096 A * 3/1999 Soes et al. 439/607.56
5,890,936 A * 4/1999 McDonald et al. 439/852
5,941,740 A * 8/1999 Neuer et al. 439/852
5,941,741 A * 8/1999 Dobbelaere et al. 439/852
5,975,963 A * 11/1999 Higuchi et al. 439/851
6,000,974 A * 12/1999 Hotea 439/851
6,012,944 A * 1/2000 Hatakeyama 439/441
6,039,584 A * 3/2000 Ross 439/115
6,039,597 A * 3/2000 Getselis et al. 439/441
6,050,845 A 4/2000 Smalley, Jr. et al.
6,051,781 A * 4/2000 Bianca et al. 174/351
6,080,008 A * 6/2000 Frantz 439/441
6,089,880 A * 7/2000 Miyagawa et al. 439/82
6,128,181 A * 10/2000 Higami et al. 361/600
6,135,784 A * 10/2000 Pei 439/70
6,171,126 B1 * 1/2001 Wu et al. 439/224
6,186,840 B1 * 2/2001 Geltsch et al. 439/843
6,193,567 B1 * 2/2001 Hsieh 439/853
6,210,240 B1 * 4/2001 Comerci et al. 439/853
6,264,498 B1 * 7/2001 Froberg 439/441
6,283,769 B1 * 9/2001 Asao et al. 439/76.2
6,309,236 B1 * 10/2001 Ullrich 439/226
6,315,591 B2 * 11/2001 Oda et al. 439/252
6,319,076 B1 * 11/2001 Gollhofer et al. 439/862
6,371,772 B1 * 4/2002 Yoneyama et al. 439/79
6,379,179 B2 * 4/2002 Shinohara 439/510
6,383,039 B1 * 5/2002 Yoneyama et al. 439/856
6,394,829 B1 * 5/2002 Patterson et al. 439/252
6,394,858 B1 * 5/2002 Geltsch et al. 439/852
6,439,934 B1 * 8/2002 Yu 439/733.1
6,442,036 B2 * 8/2002 Komatsu 361/758
6,475,042 B1 * 11/2002 Yu 439/857
6,478,635 B2 * 11/2002 Charles et al. 439/851
6,511,336 B1 * 1/2003 Turek et al. 439/249
6,551,143 B2 * 4/2003 Tanaka et al. 439/682
6,561,828 B2 * 5/2003 Henrici et al. 439/239
6,652,303 B2 * 11/2003 Stockel et al. 439/215
6,776,635 B2 * 8/2004 Blanchfield et al. 439/181
6,805,591 B2 * 10/2004 Garland et al. 439/733.1
6,814,598 B2 * 11/2004 Hoffmann et al. 439/249
6,827,613 B2 * 12/2004 Ferderer 439/805
6,991,498 B2 * 1/2006 Wertz et al. 439/830
7,048,597 B2 * 5/2006 Chen 439/851
7,175,469 B1 * 2/2007 Daily et al. 439/441
7,217,162 B2 * 5/2007 Harada et al. 439/857
7,303,421 B2 * 12/2007 Liao 439/342
7,320,616 B1 1/2008 Legrady et al.
7,357,651 B2 * 4/2008 Minoura et al. 439/82
7,503,814 B1 * 3/2009 Lin 439/857
7,530,837 B2 * 5/2009 Nieleck et al. 439/441
7,556,509 B1 * 7/2009 Oh et al. 439/76.2
7,581,965 B1 * 9/2009 Upasani et al. 439/82
7,654,874 B2 * 2/2010 Ader 439/857
7,704,103 B1 * 4/2010 Rhein et al. 439/752.5
7,731,550 B2 * 6/2010 Falchetti 439/857
7,771,217 B2 * 8/2010 Bethurum et al. 439/153
7,771,243 B2 * 8/2010 Peterson et al. 439/857
7,780,489 B2 * 8/2010 Stuklek 439/825
7,806,738 B2 * 10/2010 Wu et al. 439/860
7,892,050 B2 * 2/2011 Pavlovic et al. 439/839
7,967,648 B2 * 6/2011 Byrne 439/856
7,988,506 B2 * 8/2011 Peterson et al. 439/857
7,997,915 B2 * 8/2011 Pueschner et al. 439/268
8,062,046 B2 * 11/2011 Daily et al. 439/290
8,096,814 B2 * 1/2012 Schell et al. 439/79
8,113,859 B2 * 2/2012 Kim 439/239
8,182,299 B2 * 5/2012 Schrader 439/857
8,206,182 B2 * 6/2012 Kuo et al. 439/676
8,221,167 B2 * 7/2012 Kuo et al. 439/660
D668,621 S * 10/2012 Gieski D13/154

(56) References Cited

U.S. PATENT DOCUMENTS

| | | | | |
|---|---|---|---|---|
| 8,277,240 | B2 * | 10/2012 | Urano | 439/232 |
| 8,339,235 | B2 * | 12/2012 | Beckert et al. | 337/198 |
| 8,446,733 | B2 * | 5/2013 | Hampo et al. | 361/775 |
| 8,512,050 | B2 * | 8/2013 | McGreevy et al. | 439/76.1 |
| RE44,490 | E * | 9/2013 | Kirstein et al. | 439/839 |
| 2002/0009908 | A1 | 1/2002 | Liu et al. | |
| 2002/0187670 | A1 * | 12/2002 | Cisey | 439/441 |
| 2004/0038597 | A1 * | 2/2004 | Norris | 439/857 |
| 2005/0054244 | A1 * | 3/2005 | Werner et al. | 439/682 |
| 2008/0076277 | A1 * | 3/2008 | Chen et al. | 439/78 |
| 2008/0124956 | A1 * | 5/2008 | Wu | 439/80 |
| 2008/0214027 | A1 * | 9/2008 | Schell et al. | 439/79 |
| 2009/0209143 | A1 * | 8/2009 | Wu et al. | 439/862 |
| 2010/0173540 | A1 * | 7/2010 | Lee et al. | 439/861 |
| 2011/0039458 | A1 * | 2/2011 | Byrne | 439/861 |
| 2011/0076901 | A1 * | 3/2011 | Glick et al. | 439/839 |
| 2012/0083141 | A1 * | 4/2012 | Molnar et al. | 439/82 |
| 2012/0108113 | A1 * | 5/2012 | Yamaguchi et al. | 439/842 |
| 2012/0295494 | A1 * | 11/2012 | Chen | 439/861 |
| 2013/0210247 | A1 * | 8/2013 | Wang et al. | 439/83 |

OTHER PUBLICATIONS

Non-Final Office Action received in U.S. Appl. No. 13/927,231 mailed Sep. 13, 2013 (19 pages).

* cited by examiner

SINGLE ELEMENT WIRE TO BOARD CONNECTOR

FIELD OF THE INVENTION

The present invention relates generally to the field of electrical connectors, and more particularly to a type of connector used to connect an insulated wire to a component, such as a printed circuit board (PCB).

BACKGROUND

Various types of connectors are known in the art for forming connections between an insulated wire and any manner of electronic component. These connectors are typically available as sockets, plugs, and shrouded headers in a vast range of sizes, pitches, and plating options. Many of these conventional connectors are referred to as Insulation Displacement Connectors (IDC) in that they include one or more contact elements incorporating a set of blades or jaws that cut through the insulation around the wire and make electrical contact with the conductive core in a one-step process, thus eliminating the need for wire stripping and crimping, or other wire preparation. IDC's are used extensively in the telecommunications industry, and are becoming more widely used in printed circuit board (PCB) applications.

Various attempts have been made to configure IDC's for surface mounting technology (SMT) applications as well. For example, U.S. Pat. No. 7,320,616 describes an IDC specifically configured for SMT mounting to a PCB. The connector assembly has at least one contact member with a piercing, cutting or slicing end that is slideably disposed within a main body, and a mounting end that extends from the main body and is attached to a printed circuit board using conventional SMT processes. An insulated conductor, such as a wire, cable and/or ribbon, is inserted in a channel in the main body without being pierced by the piercing end of the contact. When a user pushes down on the top portion of the main body, the contact slides into the channel and pierces the insulated conductor. The top portion of the main body also provides a surface for a vacuum pick-up nozzle in an automated pick-and-place assembly process.

AVX Corporation of South Carolina, USA, offers a line of low profile IDC wire to board connectors (Series 9175-9177) that are SMT (surface mount technology) mounted to a circuit board prior to insertion of wires into contact slots with the aid of a hand tool. This process cuts the wire insulation and enables the conductive wire cores to form a secure conductive joint with the connector.

IDC wire to board connectors are, however, not suited for all applications wherein it is desired to connect one or more wires to a component. For example, the IDC's in the above cited references are relatively complicated in that they require multiple parts that are movable relative to each other. A main insulative body is a separate component from the contact element and all or a portion of the main body must be movable or slidable relative to the contacts to make final connection with the wires after ends of the contacts have been inserted into through holes in the PCB or surface mounted to the PCB. The main insulative body of conventional IDC's can also take up valuable space (real estate) on the PCB. In this regard, IDS's are relatively complex, large, and can be cost prohibitive in certain applications.

The present invention provides an alternative to IDC wire to board connectors that is rugged, reliable, and simple in design.

SUMMARY

Objects and advantages of the invention will be set forth in part in the following description, or may be obvious from the description, or may be learned through practice of the invention.

In accordance with aspects of the invention, an electrical connector is provided that is particularly well suited for connecting at least one insulated conductive core wire to an electrical component, such as a PCB. It should be appreciated that connectors according to the invention are not limited to use with boards, but may used in any application wherein a secure electrical connection is desired between wires and any other type of component. The connectors will be described herein as used to connect wires to PCB's for illustrative purposes only.

In accordance with aspects of the invention, the connector is a "single element" connector in that it is formed from a single conductive contact member and does not include an insulative body or molding. The connector is particularly suited for a pick-and-place mounting process wherein a vacuum transfer device places the connector for subsequent surface mounting to a PCB, as is understood by those skilled in the art. The connectors are not, however, limited to this mounting technique.

An embodiment of a single element electrical connector in accordance with aspects of the invention includes a single conductive contact element formed into a cage structure, with this cage structure defining a wire insert end and a wire contact end arranged along a longitudinal centerline axis of the connector. The cage structure includes a wall structure at the insert end that defines an inlet opening for a wire at the insert end. For example, in one embodiment, the wall structure may include a plurality of walls formed into a box-like structure at the insert end, with one of the walls defining an upper pick-up surface having a surface area suitable for placement of a suction nozzle of a vacuum transfer device. The cage structure further includes a pair of contact tines biased towards the centerline axis of the connector downstream of the wall structure at the insert end in an insertion direction of the wire into the connector, with the contact tines defining a contact pinch point for an exposed core of the wire. A component of the cage structure defines a contact surface for electrical mating contact with a respective contact element or pad on the component to which the connector is mounted, such as a PCB.

In a particular embodiment, the connector is formed from a single stamped metal sheet bent or otherwise formed into the cage structure. Any number and configuration of cuts, reliefs, and the like, may be formed in the metal sheet to facilitate bending or otherwise shaping the metal sheet into the cage structure having the features described herein.

As mentioned, in a particular embodiment, the cage structure includes a plurality of walls bent into a box-like structure having a top wall, bottom wall, and side walls at the insert end of the connector, with the top wall defining the pick-up surface. In this embodiment, the top wall may be a bent-over extension of one of the side walls that extends to the opposite side wall.

The top and bottom walls may be generally parallel in one embodiment, with one or both of the top and bottom walls including a forward portion that is angled towards the centerline axis of the connector to define an upper wire guide (top wall) and/or lower wire guide (bottom wall).

The contact tines may be variously configured by the cage structure. In a particular embodiment, the contact tines are forward portions of the side walls that are angled towards the centerline axis at the wire contact end of the connector. The tines may include release tabs extending from a forward-most portion of the contact tines, with the release tabs configured for engagement by a tool to separate the contact tines in order to remove a wire inserted into the connector. The release tabs may extend generally parallel to the centerline axis.

In another embodiment, the cage structure may include an end wire stop wall defined forward of the contact tines in an insertion direction of a wire into the connector, with this wall defining the ultimate end position of the conductive core of the wire in the connector. The stop wall may be variously configured by the cage structure. For example, in one embodiment, the bottom wall may extend below the contact tines, with the stop wall defined by a forward portion of the bottom wall that is bent upwards towards the centerline axis.

As mentioned, the connector is not limited by its mounting technique to a PCB or other component. In one embodiment, the contact surface is defined by a portion of the bottom wall of the cage structure such that the connector is surface mountable to a contact pad on a PCB with the centerline axis generally parallel to the PCB. In another embodiment, the connector may be intended for a through-board or top mount configuration wherein the connector extends generally perpendicular to the PCB. In this configuration, the contact surface may be defined by contact feet extending generally transversely from the walls (bottom, top, or side walls).

The present invention also encompasses any manner of electrical component assembly that incorporates the unique connector element introduced above and described in detail below to electrically connect one or more wires to an electrical component. For example, the component assembly may include a PCB in electrical mating contact with one or more conductive wires via the electrical connector.

Particular embodiments of the unique insulation displacement connectors are described in greater detail below by reference to the examples illustrated in the drawings.

DETAILED DESCRIPTION

Figure 1:
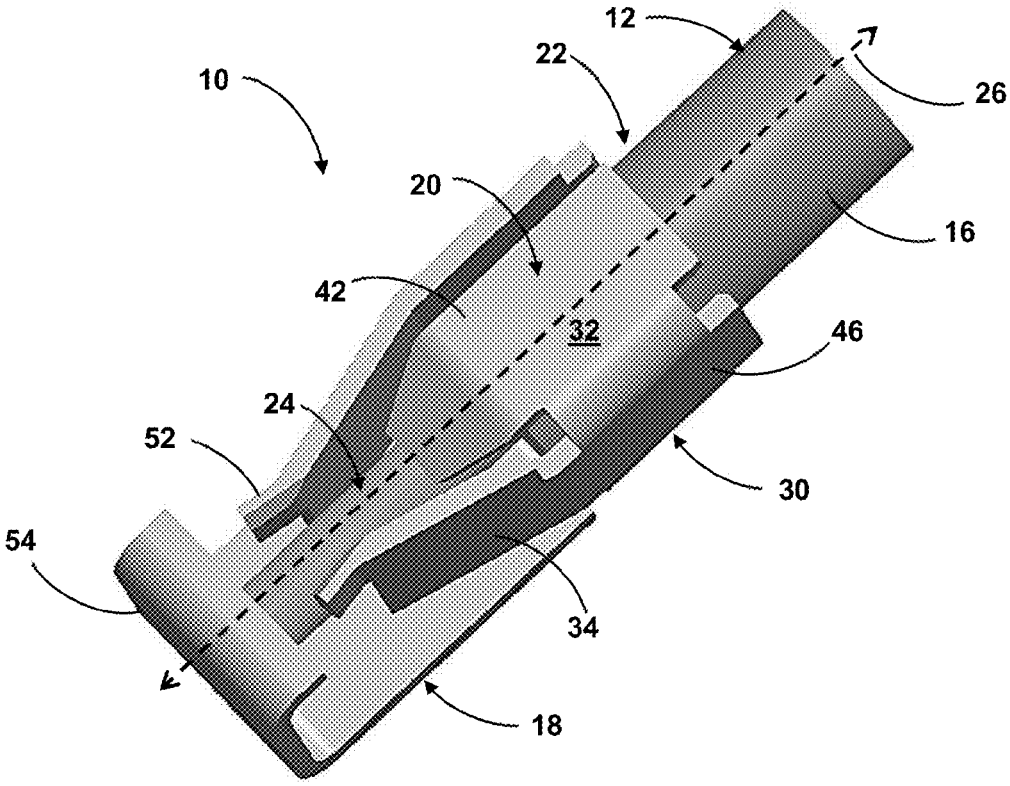
FIG. 1 is a perspective view of an embodiment of a connector according to aspects of the invention.

Reference will now be made to embodiments of the invention, one or more examples of which are illustrated in the figures. The embodiments are provided by way of explanation of the invention, and are not meant as a limitation of the invention. For example, features illustrated or described as part of one embodiment may be used with another embodiment to yield still a further embodiment. It is intended that the present invention encompass these and other modifications and variations as come within the scope and spirit of the invention.

Exemplary embodiments of an electrical connector 10 according to aspects of the invention are illustrated in FIGS. 1 through 8. The electrical connector 10 is configured for connecting the conductive core of an insulated wire to any manner of electrical component, such as a printed circuit board (PCB). For ease of explanation and illustration, the connector 10 is illustrated and referred to herein in the context of connecting wires to a PCB. In addition, the connector 10 is depicted in the figures as a "single-way" connector in that it includes only a single wire position. It should be appreciated that the connector 10 is not limited by the number of wire positions, and multi-way embodiments are contemplated within the scope and spirit of the invention. For example, the invention includes embodiments wherein the cage structure is formed into a two-way or a three-way connector in addition to the illustrated single-way connector.

Referring to the figures in general, an embodiment 10 of a single element electrical connector in accordance with aspects of the invention is depicted. The connector 10 is particularly suited for connecting a wire 12 to any manner of electrical component, such as a PCB. The wire 12 may be a stranded or solid core wire having a core 14 surrounded by insulation material 16. Prior to insertion of the wire 12 into the connector 10, a section of the insulation material 16 is stripped away from the core 14 adjacent to the end of the wire 12, as depicted particularly in FIGS. 1 and 2.

As mentioned above, the connector 10 is a "single element" connector in that it is formed from a single conductive contact element 18. This element 18 may be any suitable conductive metal material having a gauge and other physical characteristics suitable for maintaining the shape of the connector 10 in the mounting process, as well as in the operating environment of the electrical component to which the connector 10 is mounted.

Figure 2:
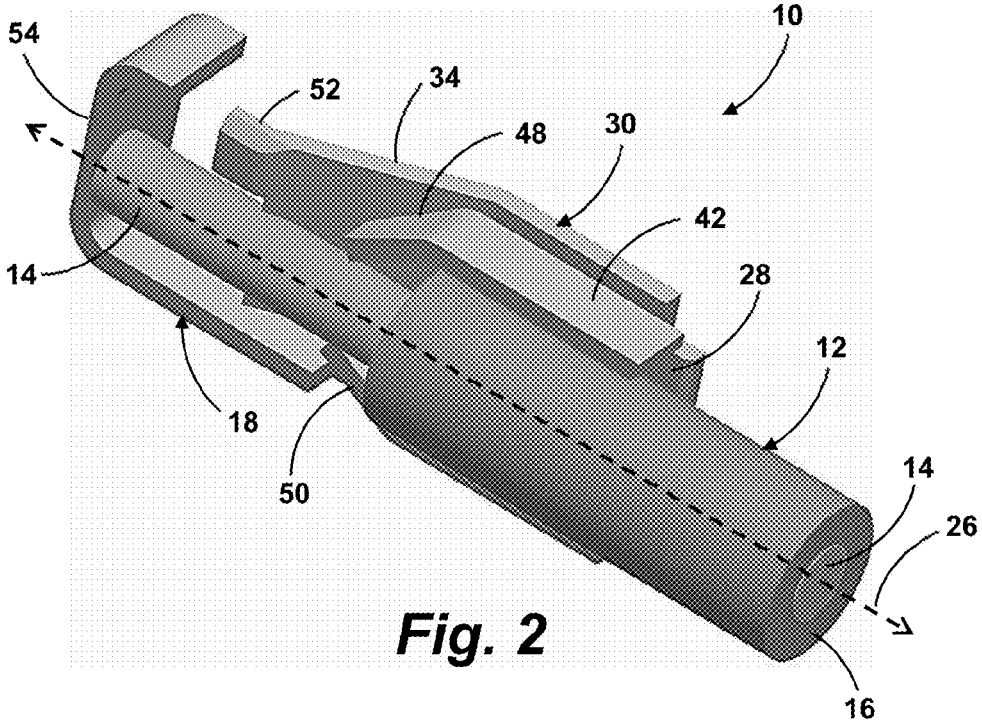
FIG. 2 is a side cut-away view showing the connector embodiment of FIG. 1.

The single conductive element 18 is formed into a cage-like structure depicted generally as element 20 in FIG. 1. The cage structure 20 includes a wire insert end 22 that defines an inlet opening 18 for insertion of the conductive core wire 12 into the connector 10. The cage structure 20 also defines a wire contact end 24 (FIG. 1), which is the end of the cage structure at which the exposed conductive core 14 of the wire 12 is contacted by the contact element 18. The insert end 22 and wire contact end 24 are aligned along a central longitudinal axis 26 of the connector 10, as depicted in FIGS. 1 and 2.

In the illustrated embodiment, the cage structure 20 includes a wall structure 30 that essentially surrounds the wire 12. The wall structure 30 may include any number and configuration of walls, such as a circular wall, semi-circular wall components, and so forth. At least a portion of the wall structure 30 defines an upper pick-up surface 32. This surface 32 has a surface area that is suitable for placement of a suction nozzle of a vacuum transfer device so that the connectors 10 may be transferred to an electrical component, such as a PCB, in a conventional pick-and-place process, as is understood by those skilled in the art. In a desirable embodiment, the connectors 10 are supplied in tape form that is fed to a conventional vacuum transfer device in the pick-and-place process.

The cage structure 20 includes a pair of contact tines 34 that are biased towards the centerline axis 26 of the connector 10 downstream of the wall structure 30 in the insertion direction of the wire 12 into the connector 10. These contact tines 34 are defined by sections or cutouts of the single contact element 18 and define a contact pinch point 36 (FIG. 3) for contact against the exposed core 14 of the wire 12. The pinch point 36 also serves as a clamp point to prevent inadvertent removal of the wire 12 from the connector 10.

The connector 10 includes a contact surface 38 that may be defined by any member or section of the cage structure 20. The contact surface 38 is provided for electrical mating contact with a respective contact element on the electronic component. For example, the contact surface 38 may be defined by any section of the bottom portion or wall of the cage structure 30 that mates with a corresponding contact pad on the PCB, wherein the connector 10 may be surface mounted directly onto the contact pad of the PCB.

In the illustrated embodiment, the connector 10, in particular the contact element 18, is formed from a single metal sheet material that is bent or otherwise formed into the cage structure 30. Any manner of cuts, reliefs, or other structures may be cut or stamped into the single contact element 18 to facilitate forming the contact element 18 into the overall configuration of the connector 10 as described herein.

In the depicted embodiment, the wall structure 30 includes a plurality of walls that are bent into a box-like structure 40 having a top wall 42, bottom wall 44, and opposite side walls 46. The top wall 42 defines the pick-up surface 32 discussed above. It should also be appreciated that any one of the other walls may also define the pick-up surface 32. The box-like structure 40 may be defined by the walls in various ways. For example, in the depicted embodiment, the side walls 46 are components that are bent upwardly relative to the bottom wall 44, while the top wall 42 is defined by an extension of one of the side walls 46 that is bent towards the opposite side wall 46.

Certain embodiments of the connector 10 may also include guide surfaces within the cage structure 20 that serve to physically contact and align the wire 12 within in the structure 20. In the illustrated embodiment, for example, an upper wire guide 48 is defined by an angled portion of the top wall 42. This upper wire guide 48 is angled from the generally parallel top wall (parallel to the bottom wall 44) towards the centerline axis 26, as particularly illustrated in FIGS. 2 and 3. Similarly, the bottom wall 44, which may be parallel to the top wall 42, may have a forward portion that is angled towards the centerline axis 26 to define a lower wire guide 50, as is particularly seen in FIGS. 2, 6, and 7.

As mentioned the contact tines 34 may be variously configured within the cage structure 20. In the illustrated embodiment, the tines 30 are defined by forward portions of each of the side walls 46 that are bent or angled towards the centerline axis 26 to the pinch point 36. In this manner, the tines 34 are biased towards each other (and the centerline axis 26). The tines 34 separate and engage against the conductive core 14 of the wire as the wire is inserted through the tines 34.

Figure 3:
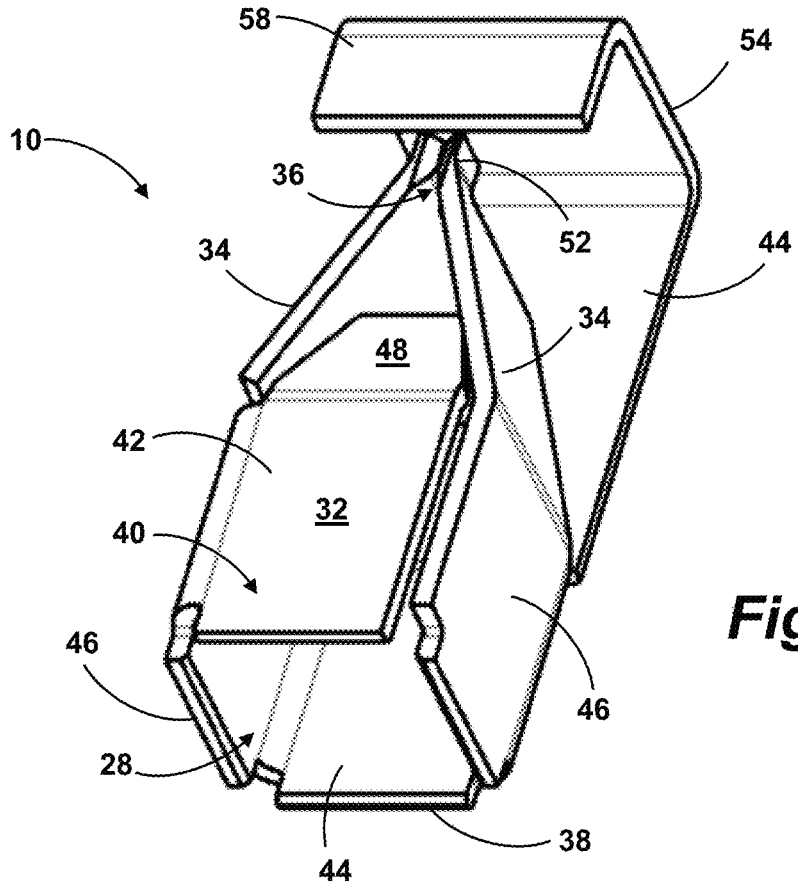
FIG. 3 is a perspective top and insert end view of a connector in accordance with aspects of the invention.
Figure 4:
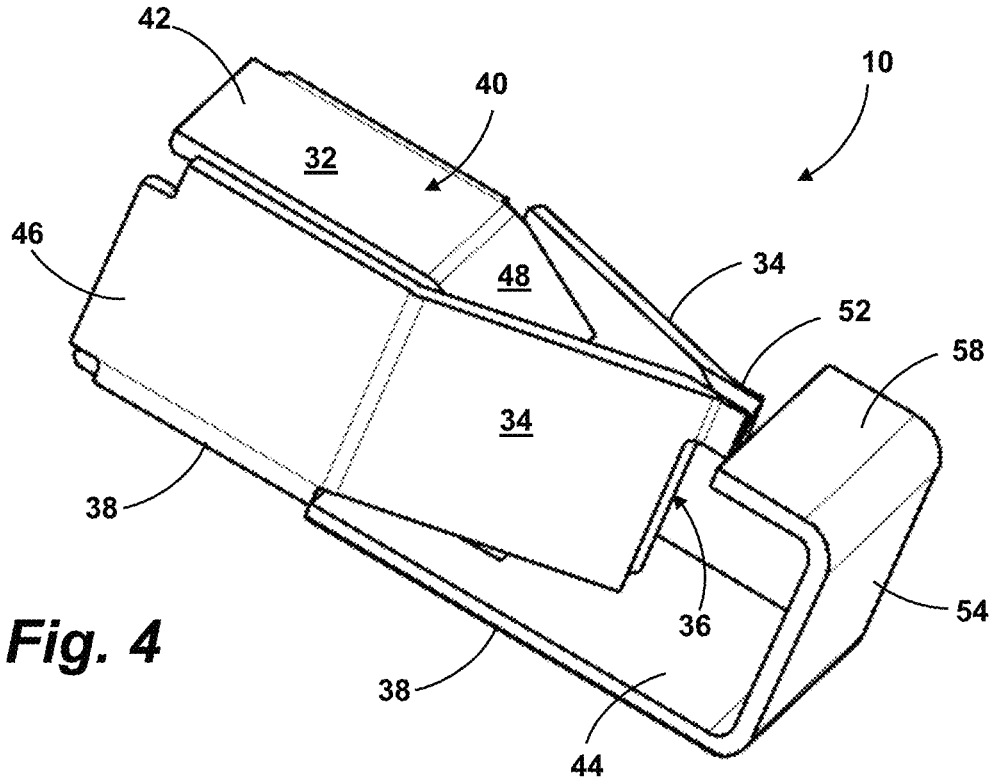
FIG. 4 is a perspective side view of the connector embodiment of FIG. 3.
Figure 5:
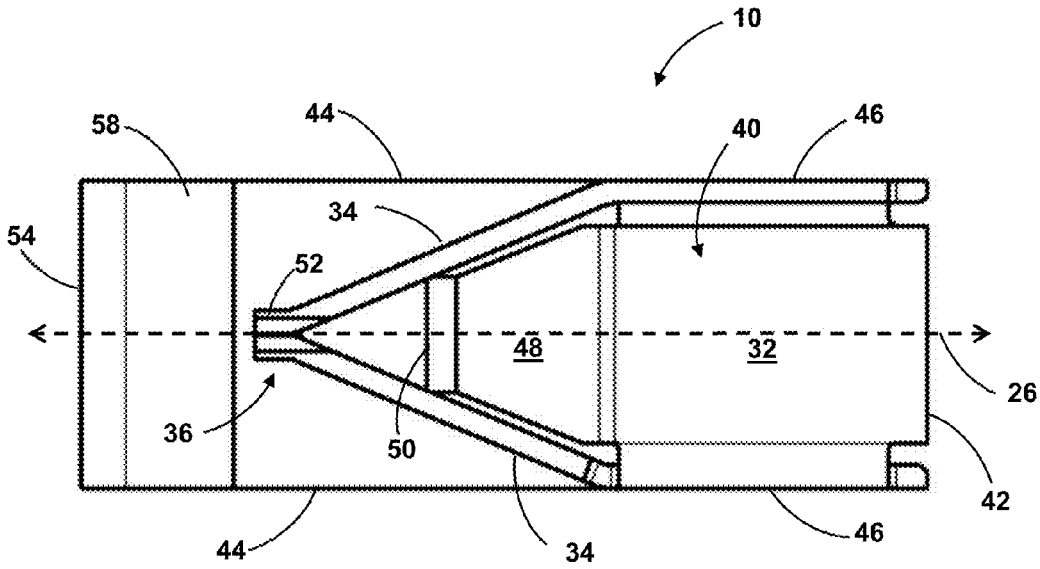
FIG. 5 is a top view of the connector embodiment of FIG. 3.
Figure 6:
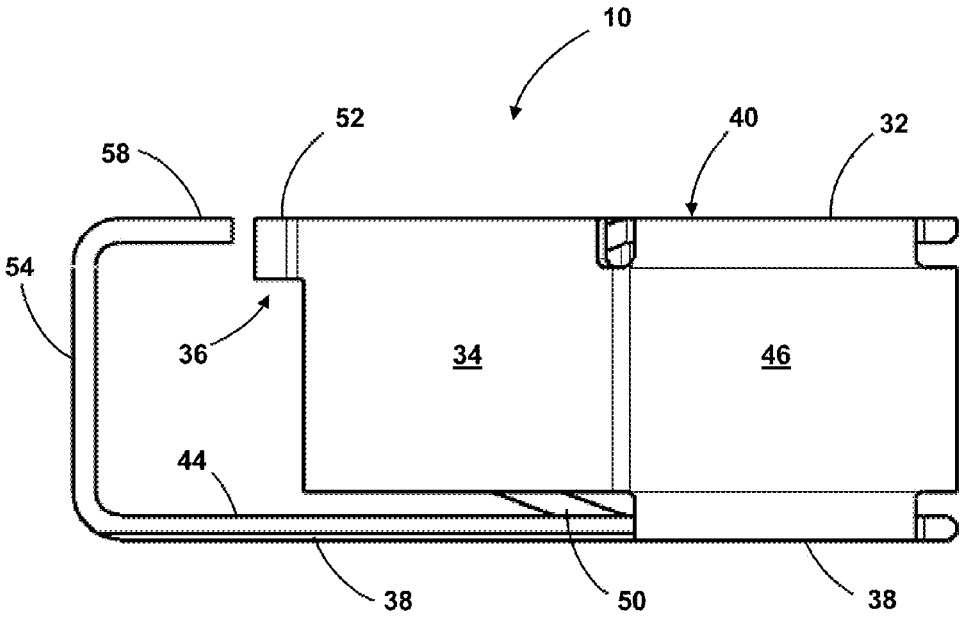
FIG. 6 is a side view of the connector embodiment of FIG. 3.
Figure 7:
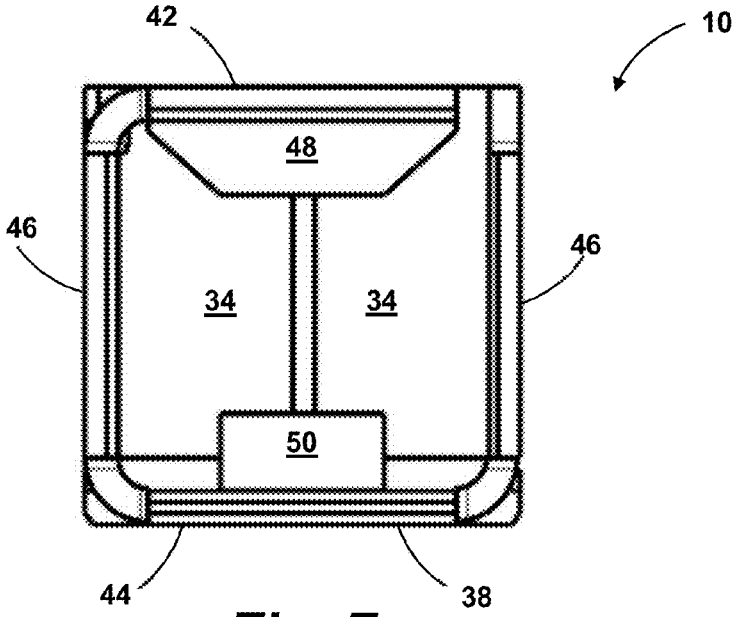
FIG. 7 is an end view of the connector embodiment of FIG. 3.

Referring particularly to FIGS. 3 and 5, in certain embodiments it may be desired to include a release tab 52 defined on each of the contact tines 34 generally forward of the pinch point 36. These release tabs 52 provide a location for insertion of a tool between the tines 34 in order to open the tines 34 for removal of the wire 12 if desired. The release tabs 52 may be variously configured. In the illustrated embodiment, the release tabs 52 are defined by generally forwardly extending tabs that are essentially parallel to the centerline axis 26 with the wire 12 removed from the connector 10, as particularly depicted in FIG. 5.

In certain embodiments as depicted in the figures, it may also be desired to include a wire stop wall 54 at the end of the wire contact end 24 of the cage structure 20. This contact wall 54 provides a surface against which the conductive core 14 of the wire 12 abuts in the completely inserted position of the wire 12, as depicted in FIG. 2. This contact wall 54 may be variously configured. In the illustrated embodiment, the contact wall 54 is formed from a bent-up portion of the bottom wall 44. The wall 54 may further include an overhang or lip 58 that extends back towards the pinch point 36 of the contact tines 34. This overhang 58 may serve to prevent inadvertent removal of the wire 12 in a vertical direction relative to the connector 10.

As mentioned, contact surface 38 may be defined by any portion of the bottom wall 44 (or any other wall) that aligns with a mating contact pad on a PCB. In this embodiment, the connector 10 is particularly suited for conventional surface mount processes.

Figure 8:
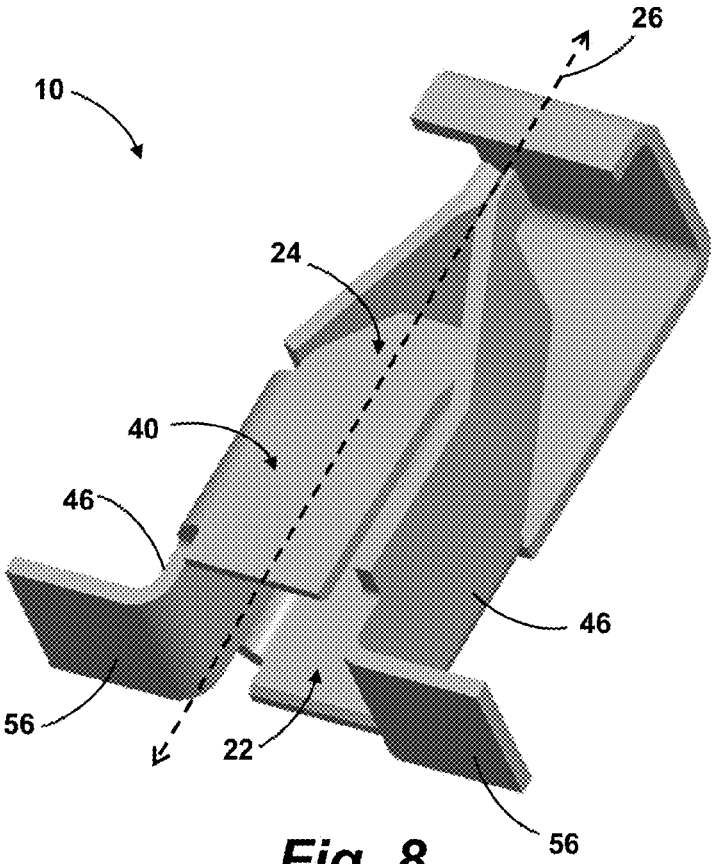
FIG. 8 is a perspective view of an alternative embodiment of a connector in accordance with aspects of the invention.

In an alternate embodiment depicted in FIG. 8, the connector 10 may be configured for a thru-board connection wherein the connector extends through a hole in a PCB. Contact feet 56 are provided for mating against a contact pad on either side of the thru-hole in the PCB. Similarly, the contact fete 56 may serve for surface mounting of the connector 10 on a PCB wherein the connector 10 assumes a relatively vertical (i.e., perpendicular) orientation relative to the PCB. In the embodiment depicted in FIG. 8, the contact feet 56 are defined by outwardly bent portions of each side wall 46. In an alternate embodiment, the contact feet 56 may also be defined by outwardly bent portions of the bottom wall 44 and top wall 42.

It should be readily appreciated by those skilled in the art that various modifications and variations can be made to the embodiments of the invention illustrated and described herein without departing from the scope and spirit of the invention. It is intended that such modifications and variations be encompassed by the appended claims.

What is claimed is:

1. A single element electrical connector configured for connecting wires to a component, said connector comprising:

a single conductive contact element formed into a cage structure having a wire insert end and a wire contact end along a longitudinal centerline axis of said connector, wherein the wire insert end is opposite the wire contact end;

said cage structure comprising a wall structure at said insert end defining an inlet opening for a wire, said wall structure defining an upper pick-up surface, wherein said wall structure comprises a plurality of walls bent into a box-like structure, wherein a first wall of the plurality of walls comprises a first end at the wire insert end of the cage structure and a second end toward the wire contact end of the cage structure, wherein said first wall comprises a forward portion at the second end, and wherein the forward portion is angled toward said centerline axis to define an upper wire guide;

said cage structure further comprising a pair of contact tines biased towards said centerline axis downstream of said wall structure in an insertion direction of the wire into said connector, said contact tines defining a contact pinch point for an exposed core of the wire, wherein the contact pinch point is positioned downstream of the upper wire guide in the insertion direction of the wire; and a contact surface defined by a member of said cage structure for electrical mating contact with a respective contact element on the component.

2. The connector as in claim 1, wherein said connector is formed from a single stamped metal sheet bent into said cage structure.

3. The connector as in claim 2, wherein said plurality of walls comprises a top wall, bottom wall, and side walls at said insert end, said top wall defining said pick-up surface, and wherein said first wall is said top wall.

4. The connector as in claim 3, wherein said top wall is a bent-over extension of one of said side walls and extends to the opposite said side wall.

5. The connector as in claim 3, wherein said bottom wall is generally parallel to said top wall and further comprises a forward portion angled towards said centerline axis to define a lower wire guide.

6. The connector as in claim 3, wherein said contact tines are forward portions of said side walls angled towards said centerline axis.

7. The connector as in claim 6, further comprising release tabs extending from a forward-most portion of said contact tines, said release tabs configured for engagement by a tool to separate said contact tines to remove a wire inserted into said connector.

8. The connector as in claim 7, wherein said release tabs extend generally parallel to said centerline axis.

9. The connector as in claim 7, wherein at least one of said release tabs extends less than an entire distance across the forward-most portion of a respective contact tine.

10. The connector as in claim 3, wherein said contact surface is defined by a portion of said bottom wall such that said connector is surface mounted to a component with said centerline axis generally parallel to the component.

11. The connector as in claim 3, wherein said contact surface is defined by contact feet extending generally transversely from any combination of said walls such that said connector is mounted to a component with said centerline axis generally perpendicular to the component.

12. The connector as in claim 2, wherein said cage structure further comprises an end wire stop wall defined forward of said contact tines in an insertion direction of a wire into said connector.

13. The connector as in claim 12, wherein said bottom wall extends below said contact tines, said stop wall defined by a forward portion of said bottom wall that is bent upwards towards said centerline axis.

14. The connector as in claim 13, wherein the end wire stop wall extends perpendicularly from said bottom wall.

15. The connector as in claim 12, wherein the end wire stop wall comprises an overhang portion that ends toward the wire insert end of the cage structure.

16. The connector as in claim 1, wherein said upper pick-up surface has a surface area suitable for placement of a suction nozzle of a vacuum transfer device.

* * * * *